US006968867B2

(12) United States Patent
Jenkins et al.

(10) Patent No.: US 6,968,867 B2
(45) Date of Patent: Nov. 29, 2005

(54) APPARATUS AND METHOD FOR CONTROLLING CONCENTRATION GRADIENTS

(75) Inventors: Shawn Jenkins, Duluth, GA (US); Henry Skoog, Roswell, GA (US); Matthew Dudensing, San Antonio, TX (US); Lidia Vega, San Antonio, TX (US); Hector Barrera, San Antonio, TX (US); Thao Doan, Fort Worth, TX (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/748,863

(22) Filed: Dec. 30, 2003

(65) Prior Publication Data

US 2005/0145293 A1 Jul. 7, 2005

(51) Int. Cl.[7] ..... B65B 1/04

(52) U.S. Cl. ..... 141/2; 141/18; 141/392; 141/129; 141/67

(58) Field of Search ..... 141/392, 2, 18, 141/286, 129, 144, 67; 222/565, 575; 239/548

(56) References Cited

U.S. PATENT DOCUMENTS 2,382,151 A * 8/1945 Harper, Jr. ..... 239/558
2,775,486 A * 12/1956 King ..... 222/190
4,097,000 A 6/1978 Derr
4,512,379 A * 4/1985 Hennig ..... 141/286
5,044,560 A 9/1991 Cheng
5,094,278 A * 3/1992 Arao et al. ..... 141/311 A
5,168,905 A 12/1992 Phallen
5,909,846 A * 6/1999 Sasaki ..... 239/106
5,972,426 A 10/1999 Kutsuzawa et al.
5,975,432 A 11/1999 Han
6,013,315 A 1/2000 Mandal
6,592,058 B2 7/2003 Kassanits

* cited by examiner

*Primary Examiner*—Steven O. Douglas
(74) *Attorney, Agent, or Firm*—Dority & Manning

(57) ABSTRACT

The present invention discloses and claims a fill system and method for reducing the chemical concentration gradient in absorbent materials. The fill system includes a source of liquid connected to a nozzle for dispensing the liquid into a container. The nozzle includes a dispersal face that defines primary apertures approximately equidistant from the outer perimeter and center point on the dispersal face. The nozzle may also include secondary apertures proximate to the outer perimeter and one or more tertiary apertures proximate to the center point. The dispersal of fluid through the secondary or tertiary apertures may be less approximately one-half of the dispersal of fluid through the primary apertures.

19 Claims, 7 Drawing Sheets

APPARATUS AND METHOD FOR CONTROLLING CONCENTRATION GRADIENTS

BACKGROUND OF THE INVENTION

The present invention generally involves a fill system and method for dispensing a liquid containing a chemical into a canister containing materials that absorb, adsorb, and/or react with the chemical.

Materials within the scope of this invention include, for example, sanitary wipes, facial towels, baby wipes, and any other pre-moistened materials packaged in canisters. The materials are typically made of woven or non-woven fabric that exhibits absorbent and/or adsorbent characteristics. In lieu of adsorbent characteristics, or in addition thereto, the materials may include a reactant that can react with the chemical. As used herein, the term "woven" refers to a fabric composed of individual fibers or filaments which are interlaid in an identifiable repeating pattern, and the term "non-woven" refers to a fabric composed of randomly or non-repeating patterns of interlaid fibers or filaments.

Chemicals within the scope of this invention include, for example, active ingredients, biocides, preserving agents, surfactants, cleaning agents, and any other elements that are capable of adsorption and/or reaction with the materials. The chemicals generally exist in solution or suspension and are applied to the materials during manufacture and packaging.

The materials may be individual or perforated sheets that are stacked or rolled during manufacture and placed in a canister having an open fill side. For uniformity, the container will be generically referred to as a canister, although other types of containers, such as bags, sacks, bottles, and similar carriers are within the scope of the present invention. The canister passes through a conventional fill system designed to add liquid containing the chemical to the canister.

The conventional fill system dispenses the liquid through the open fill side into the canister containing the materials. The fill system dispenses the liquid in a column or spray of fluid, typically at a discrete location such as the center of the open fill side. Once the canisters are filled with sufficient liquid containing the chemical, a lid or permanent closure is applied to the open fill side of the canister, and absorption, adsorption, and/or reaction processes begin simultaneously, with varying results as will be explained.

The absorption process involves physical entrainment of the liquid in the fibers of the materials. Absorption occurs through wicking phenomena via the transport of liquid through interstitial spaces within the fibers. The transport of liquid (i.e., the wicking) occurs as the liquid moves from the saturated or filled interstitial spaces within the absorbent material to unsaturated or unfilled interstitial spaces within the absorbent material, without regard to the chemical concentration in the liquid. In fill processes where the liquid is added to the center of the stacked or rolled sheets, the stacked or rolled sheets absorb the liquid from the center of the canister outward to the stacked or rolled sheets at the outer perimeter of the canister. The absorption process generally produces a discernable saturation gradient, "saturation" defined as the weight of the liquid absorbed divided by the weight of the absorbent material, in stacked or rolled materials that is highest where the liquid is added, typically the center of the stacked or rolled material.

The adsorption process involves surface interaction between the chemical and the fiber surfaces of adsorbent materials. For adsorbent materials, the fiber surfaces possess a designed affinity for the chemical. As absorption occurs and the liquid passes radially outward through the fibers, as previously described, the chemical comes into contact with the fiber surfaces, and the fiber surfaces strip or adsorb the chemical from the liquid. The fiber surfaces continue to strip or adsorb the chemical from the liquid until an equilibrium condition exists between the chemical concentration on the fiber surfaces and the chemical concentration in the liquid. As absorption continues, the remaining chemical that has not been adsorbed continues to migrate radially outward with the liquid via the absorption process. This results in progressively lower chemical concentrations being exposed to the outer fibers of the stacked or rolled adsorbent materials, producing a radially outward decreasing chemical concentration gradient in the fibers of the adsorbent materials.

The reaction process, if present, produces a chemical concentration gradient similar to the adsorption process. As previously described, the absorption process transfers the liquid radially outward through the fibers. As this occurs, the chemical reacts with the reactant, removing the chemical from the liquid, and the reduced chemical concentration migrates radially outward via the absorption process. This produces a radially outward decreasing chemical concentration gradient in the materials.

Thus, the absorbent, adsorbent, and/or reaction processes combine to produce two simultaneous effects in the stacked or rolled materials. First, the absorption process produces a discernable saturation gradient in stacked or rolled materials that is highest where the liquid is added, typically the center of the stacked or rolled material. Second, the adsorption and/or reaction processes cause the chemical concentration in the liquid to diminish as the chemical passes radially outward and is progressively adsorbed by or reacts with the materials. As a result, the combination of absorbent and adsorbent and/or reaction processes produce a chemical concentration gradient in the stacked or rolled sheets that is highest at the center and decreases with distance from the center.

The present invention relates to an improved fill system and method for reducing the chemical concentration gradient in materials that absorb, adsorb, and/or react with the chemical.

SUMMARY OF THE INVENTION

Objects and advantages of the invention are set forth below in the following description, or may be obvious from the description, or may be learned through practice of the invention.

In one embodiment of the invention, an apparatus for adding liquid to a container containing a rolled or stacked absorbent material includes a source of the liquid in fluid communication with a nozzle for dispensing the liquid into the container. The nozzle includes a dispersal face having an outer perimeter and a center point, and the dispersal face defines primary apertures located approximately equidistant from the outer perimeter and the center point for dispensing the liquid to the container containing the absorbent material. The primary apertures may have a predetermined maximum size such that when flow of liquid through the dispersal face is interrupted, the surface tension of the liquid seals the primary apertures and prevents dripping. The outer perimeter of the dispersal face may be, for example, substantially circular, rectangular, or triangular.

In a particular embodiment, the dispersal face on the apparatus may further define secondary apertures between the primary apertures and the outer perimeter for dispensing the liquid to the container containing the absorbent material. The flow rate of the liquid through the secondary apertures may be approximately one-half of the flow rate of the liquid through the primary apertures.

The dispersal face of another particular embodiment may further define a tertiary aperture between the primary apertures and the center point for dispensing the liquid to the container containing the absorbent material. The flow rate of the liquid through the tertiary aperture may be approximately one-tenth of the flow rate of the liquid through the primary apertures.

The invention also includes an improved fill system for adding liquid to a container that includes a source of the liquid and a nozzle in fluid communication with the source of the liquid. The nozzle includes a dispersal face directed to the container, and the dispersal face has a center point, an outer perimeter, an inner-zone located from the center point outward to approximately one-third of the distance to the outer perimeter, an outer-zone located from the outer perimeter inward to approximately one-third of the distance to the center point, and a mid-zone located between the outer-zone and the inner-zone. The dispersal face defines primary apertures in the mid-zone for dispersing the liquid to the container from the mid-zone. The primary apertures may have a predetermined maximum size such that when flow of liquid through the dispersal face is interrupted, the surface tension of the liquid seals the primary apertures and prevents dripping. The outer perimeter of the dispersal face may be, for example, substantially circular, rectangular, or triangular shaped.

In a particular embodiment, the dispersal face may further define secondary apertures in the outer-zone for dispersing the liquid to the container from the outer-zone. The flow rate of the liquid through the secondary apertures from the outer-zone may be approximately one-half of the flow rate of the liquid through the primary apertures from the mid-zone.

The dispersal face of another particular embodiment may further define a tertiary aperture in the inner-zone for dispersing the liquid to the container from the inner-zone. The flow rate of the liquid through the tertiary aperture from the inner-zone may be approximately one-tenth of the flow rate of the liquid through the primary apertures from the mid-zone.

A further embodiment of the invention includes a method for dispersing liquid to a container containing a material having any combination of absorbent and adsorbent properties. The method includes obtaining a source of the liquid and connecting a nozzle to the source of the liquid, wherein the nozzle includes a dispersal face. The dispersal face has an outer perimeter, a center point, and defines primary apertures in the dispersal face approximately equidistant from the outer perimeter and the center point. The method further includes dispensing the liquid through the primary apertures to the container containing the material.

In a particular embodiment, the method may further include connecting the nozzle to the source of the liquid, wherein the dispersal face further defines secondary apertures in the dispersal face between the primary apertures and the outer perimeter. The method in this particular embodiment dispenses the liquid through the secondary apertures to the container containing the material. In addition, the method may include dispensing approximately twice as much liquid to the container through the primary apertures than through the secondary apertures.

In another particular embodiment, the method may further include connecting the nozzle to the source of the liquid, wherein the dispersal face further defines a tertiary aperture in the dispersal face between the primary apertures and the center point. The method in this particular embodiment dispenses the liquid through the tertiary aperture to the container containing the material. In addition, the method may include dispensing approximately ten times as much liquid to the container through the primary apertures than through the tertiary aperture.

Those of ordinary skill in the art will better appreciate the features and aspects of such embodiments, and others, upon review of the specification.

BRIEF DESCRIPTION OF THE FIGURES

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Reference will now be made in detail to present embodiments of the invention, one or more examples of which are illustrated in the accompanying drawings, with like numerals representing substantially identical structural elements. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 1:
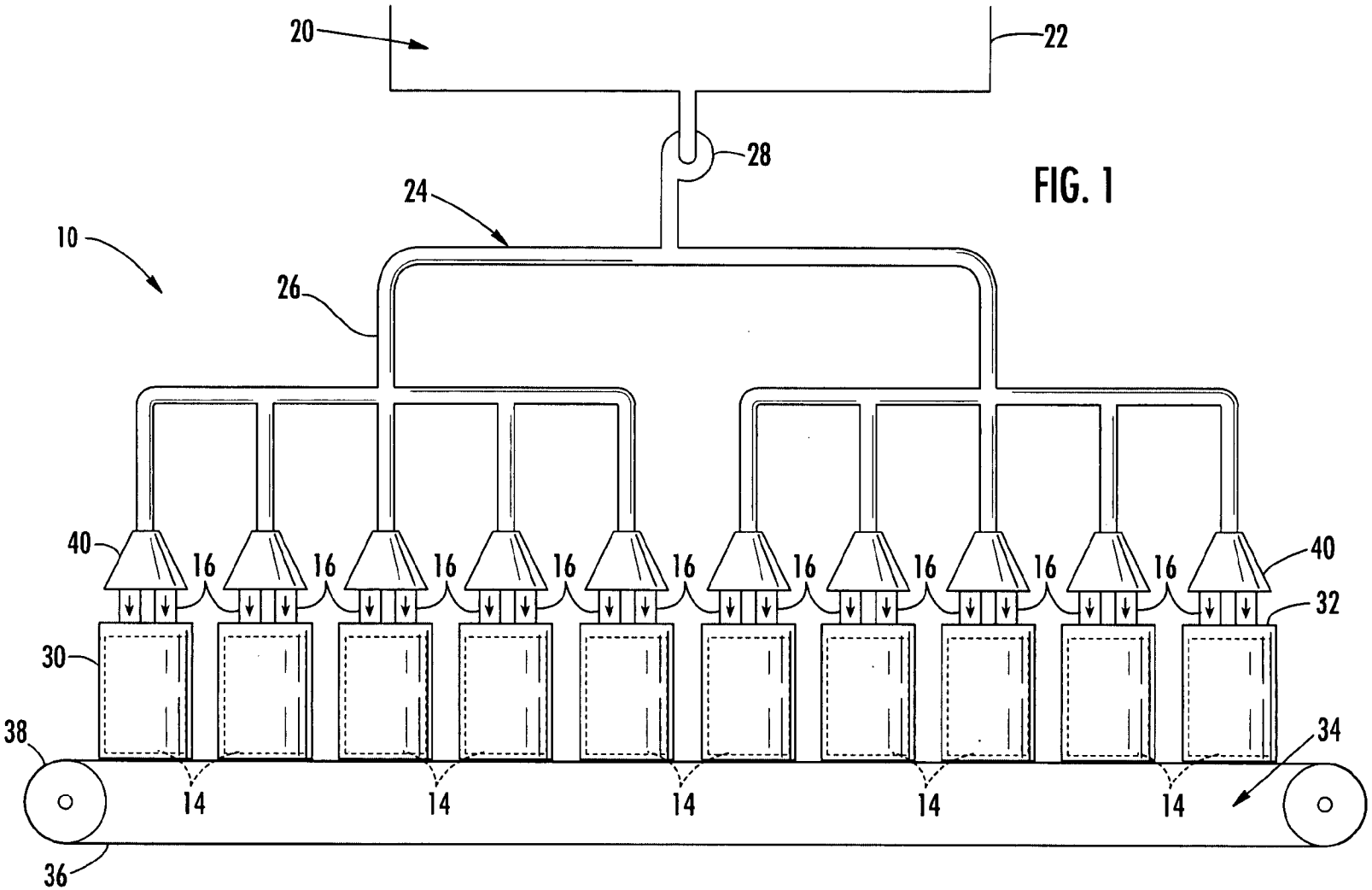
FIG. 1 is a side plan view of a typical fill system.

The present invention provides an improved fill system and method for reducing chemical concentration gradients in materials that absorb, adsorb, and/or react with the chemical. FIG. 1 illustrates a fill system 10 within the scope of the present invention. The fill system 10 generally includes a source of liquid 20, piping 24, canisters 30, a conveyor 34, and one or more nozzles 40. As shown, the fill system 10 provides a method and apparatus for batch filling multiple canisters 30 at one time as the canisters 30 pause beneath respective nozzles 40. Alternate embodiments within the scope of the present invention may include a single nozzle 40 or more nozzles 40 than depicted in FIG. 1.

The source of liquid 20 supplies the liquid containing the chemical in solution or suspension. Depending on the particular application, each canister 30 typically requires anywhere from 2–64 ounces of liquid. To conveniently and readily supply the volume of liquid, the source of liquid 20 may be a reservoir or tank 22 integral to or proximate to the fill system 10, as shown in FIG. 1. Alternately, the source of liquid 20 may be remote from the fill system 10, with the liquid being piped or transferred to the fill system 10 prior to or during operation.

The piping 24 provides fluid communication between the source of liquid 20 and the various nozzles 40. The piping 24 may be any type of tubing, piping, conduit, hose, or equivalent structure suitable for providing fluid communication between the source of liquid 20 and the nozzles 40. The piping 24 should have an inner diameter 26 sufficiently large to permit gravity flow of the liquid from the source of the liquid 20 to the nozzles 40. Alternately, the inner diameter 26 may be reduced if the fill system 10 further includes a source for pressurizing the liquid, such as a feed pump 28 (as shown in FIG. 1), air pressure, or other source of pressure.

The canisters 30 provide a secure container for holding the materials 14 that absorb, adsorb, and/or react with the chemical. The canisters 30 may be any size or shape, having associated cross-sections such as a circle, square, or triangle, depending on the desired shape of the materials 14. In addition, the canisters 30 may take on any manner of conventional package, such as the cylindrical cans illustrated in FIGS. 1 and 2*a–d* or a soft-side bag, sack, bottle, or similar carrier. These types of containers are well known and used in the industry, and a detailed description thereof is not necessary for purposes of understanding the present invention.

Each canister 30 includes an open fill surface 32 on one side. The materials 14 are stacked or rolled and inserted into the canisters 30 through the open fill surface 32. As the canisters 30 pass beneath respective nozzles 40, the nozzles 40 dispense or spray the liquid 16 onto the top of the contents through the open fill surface 32. After filling, a lid (not shown) covers the open fill surface 32 to seal the contents for storage and subsequent distribution.

The conveyor 34 provides the means for transporting the canisters 30 through the fill system 10. The conveyor 34 may include any manner of conventional structure for performing this function, such as the rudimentary belt 36 and pulley 38 illustrated by way of example in FIG. 1. Various conveyors are well known and used in the industry, and a detailed description thereof is not necessary for purposes of understanding the present invention.

The nozzles 40 dispense the liquid 16 to the canisters 30 below. Each nozzle 40 includes a dispersal face which defines a pattern of apertures through which the liquid 16 passes. The cross-section of each nozzle 40 and dispersal face generally matches the corresponding cross-section of the canisters 30 being filled, with the diameter of each nozzle 40 and dispersal face generally being equal to or less than the diameter of the canisters 30. The position and size of the apertures in the dispersal face determine the location and flow rate of the liquid 16 dispensed to the canisters 30, as will be described in more detail.

The design of the nozzle 40, specifically the design of the dispersal face, significantly influences the chemical concentration gradient in the materials 14. Two tests were conducted to determine and quantify the effect a particular spray pattern has on the chemical concentration gradient in materials 14 having absorbent and adsorbent characteristics. The two tests are described below with respect to FIGS. 2*a–d*, and the results are graphed in FIGS. 3 and 4.

Figure 2A:
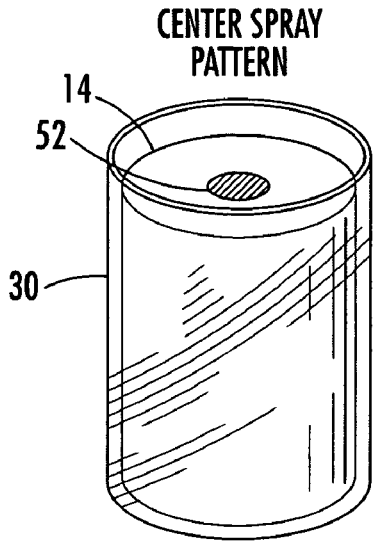
FIG. 2*a* is a perspective view of a cylindrical canister containing rolled materials with the liquid dispensed into the center of the canister.
Figure 2B:
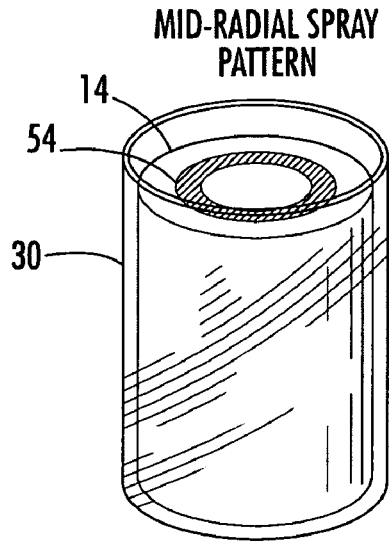
FIG. 2*b* is a perspective view of a cylindrical canister containing rolled materials with the liquid dispensed into a mid-radial position of the canister.
Figure 2C:
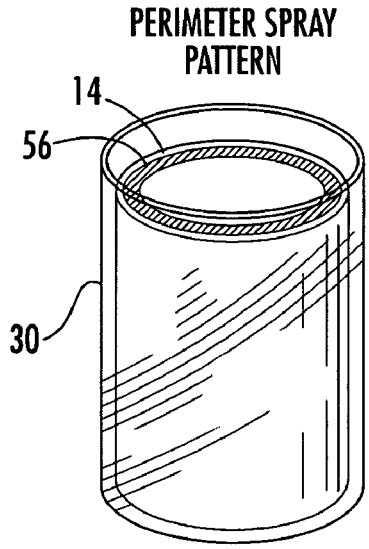
FIG. 2*c* is a perspective view of a cylindrical canister containing rolled materials with the liquid dispensed into the perimeter of the canister.
Figure 2D:
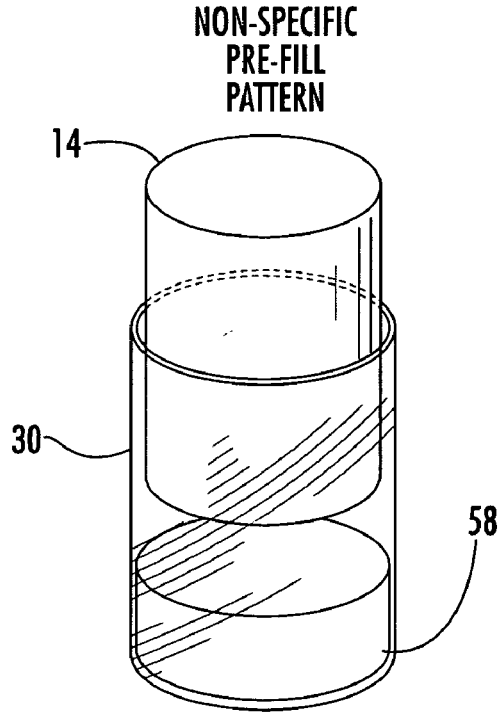
FIG. 2*d* is a perspective view of a cylindrical canister with the liquid dispensed into the canister prior to insertion of the rolled materials.

A first test was conducted to determine the effect of varying the spray pattern on the chemical concentration gradient. In the first test, a separate canister 30 was filled using each of the four spray patterns illustrated in FIGS. 2*a–d*. The spray patterns in FIGS. 2*a–d* were produced by varying the position of the apertures in the dispersal face while holding the size of the apertures constant. FIG. 2*a* illustrates a center spray pattern 52 which dispensed the liquid 16 as a column onto the materials 14 at the center of the canister 30. FIG. 2*b* illustrates a mid-radial spray pattern 54 which dispensed the liquid 16 onto the materials 14 approximately halfway between the center and outer perimeter of the canister 30. FIG. 2*c* illustrates a perimeter spray pattern 56 which dispensed the liquid 16 onto the materials 14 at the perimeter of the canister 30. FIG. 2*d* illustrates a non-specific pre-fill pattern 58 which dispensed the liquid 16 into the canister 30 prior to adding the materials 14 to the canister 30.

After the four canisters 30 were filled using each of the spray patterns 52, 54, 56, 58 illustrated in FIGS. 2*a–d*, lids were applied to the canisters 30, and the four canisters 30 were stored for five days to allow the absorption and adsorption processes to occur. After five days, the materials 14 were removed from each canister 30, and liquid 16 was expressed from individual sheets taken from different radial positions throughout the wetted materials 14. The expressed liquid from each sheet was measured for the chemical concentration, and the results were recorded. The following table summarizes the chemical concentration average gradient, calculated as the change in chemical concentration divided by the change in roll position, for each of the four canisters 30:

TABLE 1

| Spray Pattern | Δ Chemical Concentration/Δ Roll Position |
|---|---|
| Center Spray Pattern | 61.4 |
| Mid-Radial Spray Pattern | 22.7 |
| Perimeter Spray Pattern | 54.1 |
| Non-Specific Pre-Fill Pattern | 34.9 |

As shown in Table 1 above, the center spray pattern 52 produced the largest average gradient, and the mid-radial spray pattern 54 produced the smallest.

Figure 3:
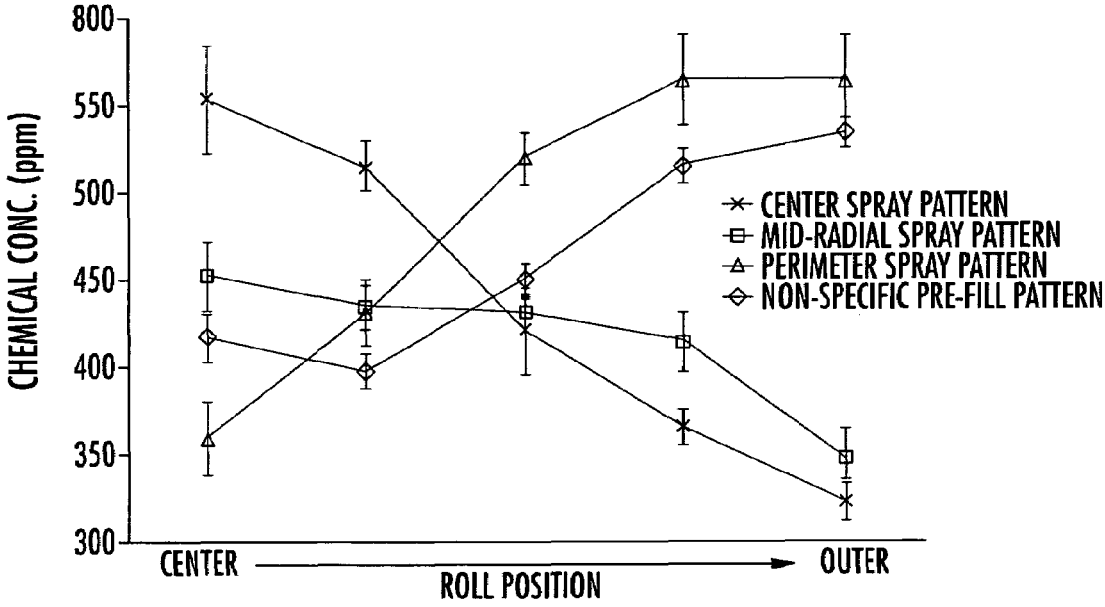
FIG. 3 is a graph of the resulting chemical concentration verses roll position for the fill methods depicted in FIGS. 2*a*–2*d;*

FIG. 3 provides a graph of the results of the first test, plotted as chemical concentration verses roll position. As illustrated, the center spray pattern 52 produced above average chemical concentration in the center sheets, decreasing chemical concentration in sheets located away from the center, and below average chemical concentration in the outer sheets. In contrast, the perimeter spray pattern 56 produced above average chemical concentration in the outer sheets, decreasing chemical concentration in sheets located toward the center, and below average chemical concentration in the center sheets. The non-specific pre-fill pattern 58 produced results similar to the perimeter spray pattern 56, with a slight decrease in the average gradient (34.9) compared to the perimeter spray pattern (54.1). Notably, the mid-radial spray pattern 54 produced the lowest average gradient (22.7), with a relatively constant chemical concentration over most of the roll and a slight decrease in chemical concentration in the outer sheets.

A second test was conducted to determine the effect of varying the spray pattern on chemical concentrations in similarly filled canisters 30. In the second test, five canisters 30 were filled using each of the spray patterns (a total of twenty canisters) illustrated in FIGS. 2*a–d* and previously described. Lids were then applied to the canisters 30, and the canisters 30 were stored for five days to allow the absorption and adsorption processes to occur. After five days, the materials 14 were removed from each canister 30, and liquid 16 was expressed from each roll of materials 14. The expressed liquid from each roll was measured for the chemical concentration, and the average ($\mu$), standard deviation ($\sigma$), and percent relative standard deviation ($\mu/\sigma$) were calculated for each group of similarly filled canisters and recorded.

Figure 4:
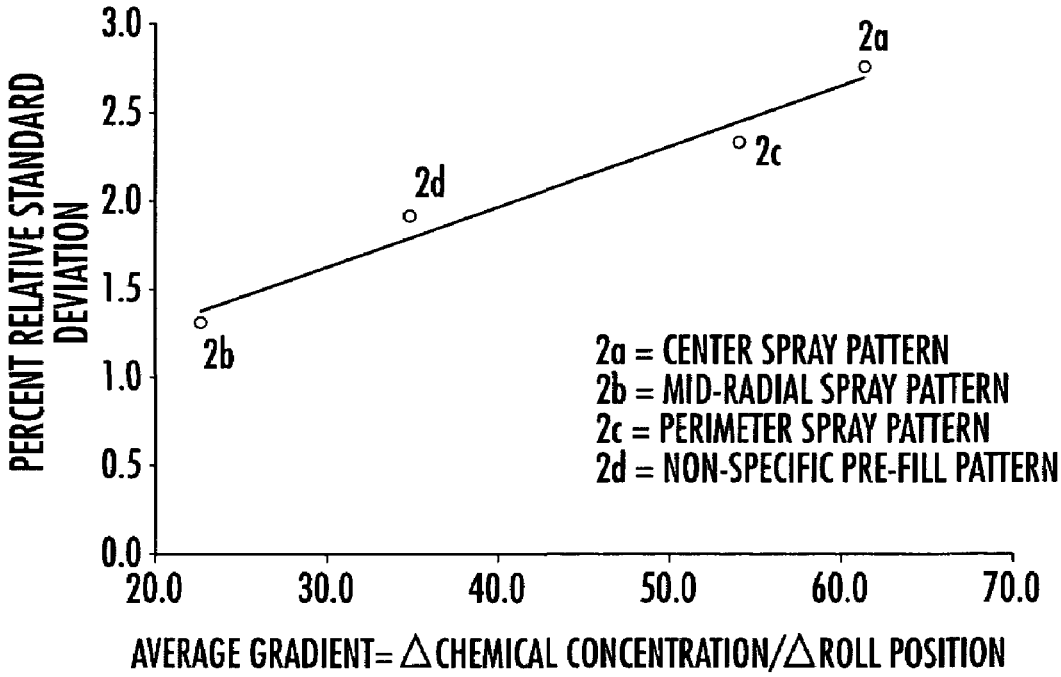
FIG. 4 is a graph of the relative standard deviation verses the average gradient for the fill methods depicted in FIGS. 2*a*–2*d;*

FIG. 4 provides a graph of the results of the second test, plotted as percent relative standard deviation (determined in the second test) verses average gradient (determined in the first test and summarized in Table 1). As illustrated, the mid-radial spray pattern 54 produced the smallest percent relative standard deviation (determined in the second test) as well as the smallest average gradient (determined in the first test).

FIGS. 5*a–c*, 6*a–c*, and 7*a–c* illustrate particular embodiments of dispersal faces within the scope of the present invention. Each particular embodiment produces a spray pattern that directly influences the chemical concentration average gradient in each canister and the relative standard deviation between canisters. The size, number, and spacing of the primary, secondary, and/or tertiary aperture(s) are generally a combined function of the liquid characteristics, the flow requirements of the fill system, and the absorbent characteristics of the materials used in particular applications, with significant interplay between each factor as will now be described in more detail.

It is desirable to only dispense the liquid when a canister is paused beneath a nozzle and particularly desirable to minimize any inadvertent dripping of liquid after the filled canisters move along the conveyor. To accomplish this, the size of each aperture should be small enough to allow the surface tension of the liquid to effectively seal each aperture and prevent it from dripping. Therefore, the maximum size of each aperture is generally a function of the surface tension of the liquid being dispensed into the canisters. For example, the surface tension of water is approximately 72 dynes/cm and suggests a maximum aperture size of approximately 3 mm. In one particular application, the surface tension of the liquid was approximately 50–65 dynes/cm, and the aperture size was accordingly reduced to approximately 2.5 mm. This combination of surface tension and aperture size permits the surface tension of the liquid to effectively seal the nozzles to prevent inadvertent dripping between canisters. The addition of chemicals or other additives that change the surface tension of the liquid will call for corresponding changes to the maximum aperture size.

Assuming a maximum aperture size as previously described, the number of apertures is generally a function of the required flow rate of liquid to the canister. For example, if the fill system pauses the canisters beneath the nozzles for 5 seconds, and each canister requires 5 ounces of liquid, then the number of apertures in each dispersal face should be sufficient to pass the required 5 ounces of liquid in the 5 seconds available. Naturally, a smaller aperture size will generally call for a similar increase in the number of apertures, and vise-versa.

Ideally, the spacing of apertures should provide maximum dispersal of the liquid over the fill surface while minimizing the amount of liquid that pools on the surface before being absorbed in the material. The optimum spacing of the apertures depends on the interplay between the size of the apertures, the number of the apertures, and the absorbent characteristics of the materials used in particular applications. For example, for a given number and size of apertures, if the space between the apertures is too small, the absorbent material will not be able to absorb the dispensed liquid fast enough, and excess liquid will pool and possibly flow uncontrollably across the surface of the material, defeating the function of the dispersal face and designed spray pattern. Conversely, if the space between the apertures is too large, the absorbent material will absorb all of the liquid at the point of application, resulting in gaps of coverage over the surface of the material.

Figure 5A:
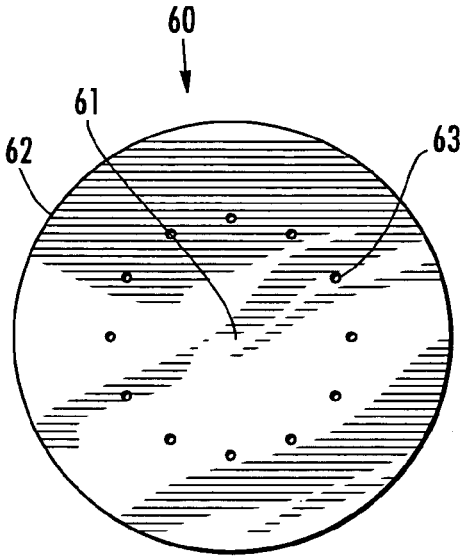
FIGS. 5*a–c* are bottom plan views of particular embodiments of a round dispersal face according to the present invention.
Figure 5B:
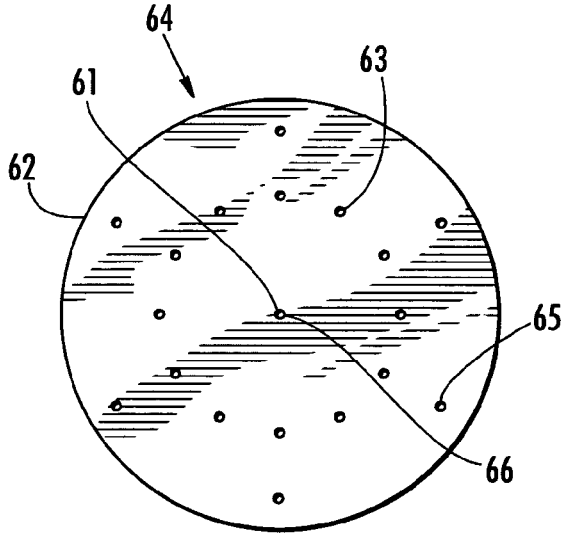
Figure 5C:
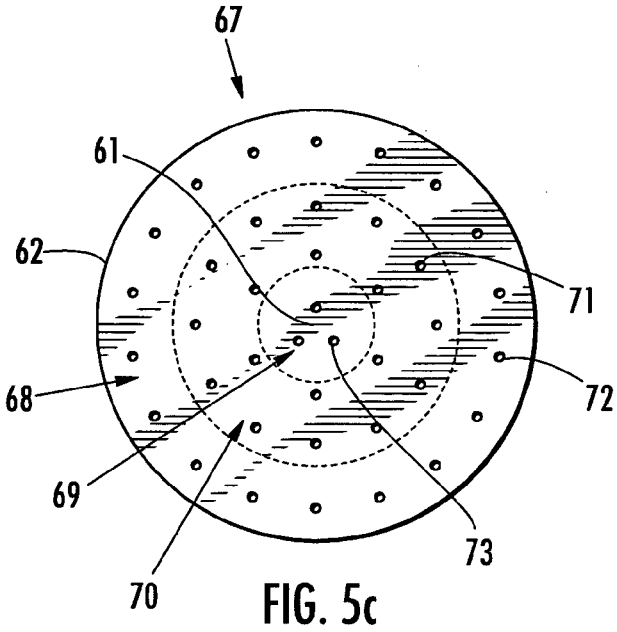

FIGS. 5*a–c* illustrate bottom plan views of particular embodiments of round dispersal faces according to the present invention.

FIG. 5*a* illustrates a substantially round dispersal face 60 having a center point 61, an outer perimeter 62, and defining primary apertures 63 located approximately equidistant from the center point 61 and the outer perimeter 62. The primary apertures 63 are shown as twelve, substantially round shapes, although other numbers and shapes, such as rectangles, diamonds, squares, and triangles, are within the scope of the present invention. The primary apertures 63 in this embodiment produce the mid-radial spray pattern 54 illustrated in FIG. 2*b*, with a corresponding chemical concentration average gradient and percent relative standard deviation as depicted in FIGS. 3 and 4 for this spray pattern.

FIG. 5*b* illustrates a substantially round dispersal face 64 having a center point 61, an outer perimeter 62, and defining primary apertures 63 located approximately equidistant from the center point 61 and the outer perimeter 62. In addition, the dispersal face 64 defines secondary apertures 65 between the primary apertures 63 and the outer perimeter 62 and a tertiary aperture 66 proximate to the center point 61. The secondary apertures 65 are shown as six, substantially round shapes, although other numbers and shapes, such as rectangles, diamonds, squares, and triangles, are within the scope of this particular embodiment. Similarly, the tertiary aperture 66 is shown as a single, round shape, although other numbers and shapes are within the scope of this particular embodiment.

The size, number, and spacing of the primary 63, secondary 65, and tertiary 66 aperture(s) in FIG. 5*b* result in more liquid being dispensed from the primary apertures 63 than from either the secondary 65 or tertiary 66 aperture(s). Specifically, the flow rate through the secondary apertures 65 is approximately 50% of the flow rate through the primary apertures 63. Similarly, the flow rate through the tertiary aperture 66 is less than approximately 10% of the flow rate through the primary apertures 63.

FIG. 5*c* illustrates a substantially round dispersal face 67 having a center point 61, an outer perimeter 62, an outer-zone 68 located from the outer perimeter 62 inward to approximately one-third of the distance to the center point 61, an inner-zone 69 located from the center point 61 to approximately one-third of the distance to the outer perimeter 62, and a mid-zone 70 located between the outer-zone 68 and the inner-zone 69. The dispersal face 67 defines primary apertures 71 in the mid-zone 70, secondary apertures 72 in the outer-zone 68, and tertiary apertures 73 in the inner-zone 69. The primary apertures 71 are shown as eighteen substantially round shapes arranged in multiple, concentric rows, although other numbers, shapes, and arrangements are within the scope of this particular embodiment. Similarly, other numbers, shapes, and arrangements of secondary 72 and tertiary 73 apertures are within the scope of this particular embodiment.

The size, number, and spacing of the primary 71, secondary 72, and tertiary 73 apertures in FIG. 5*c* result in the majority of the liquid being dispensed from the primary 71 and secondary 72 apertures. Specifically, the flow rate through the primary 71 and secondary apertures 72 is approximately equal, and the flow rate through the tertiary apertures 73 is less than approximately 20% of the flow rate through the primary apertures 71.

Figure 6A:
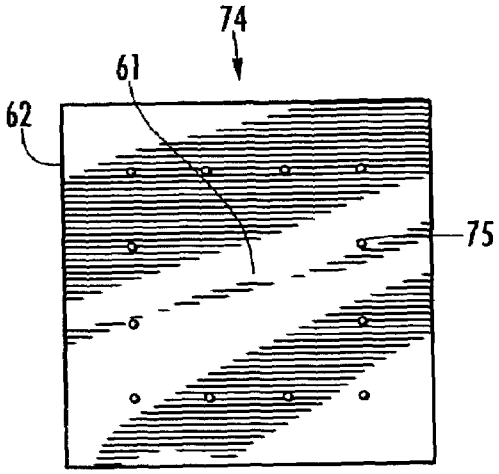
FIGS. 6*a–c* are bottom plan views of particular embodiments of a square dispersal face according to the present invention.
Figure 6B:
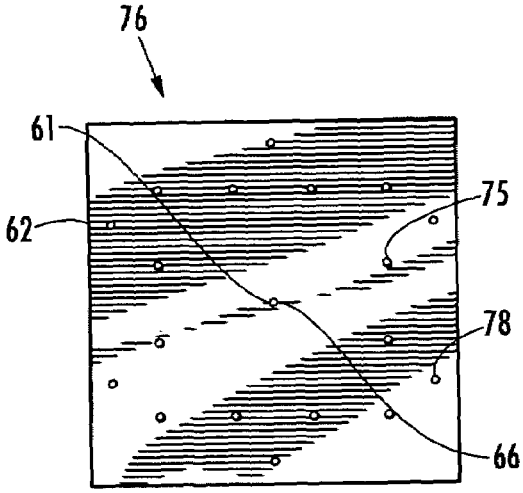
Figure 6C:
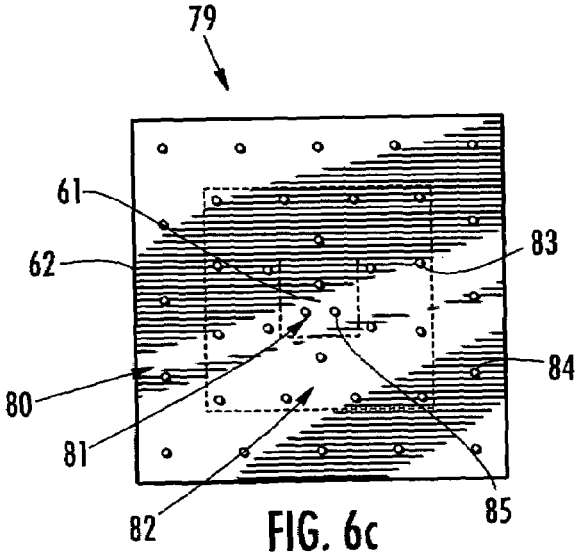

FIGS. 6*a–c* illustrate bottom plan views of particular embodiments of substantially square dispersal faces according to the present invention. The particular embodiments illustrated in FIGS. 6*a–c* generally correspond to the embodiments previously described, enabled, and illustrated in FIGS. 5*a–c*, with like numerals representing substantially identical structural elements.

FIG. 6*a* illustrates a substantially square dispersal face 74 having a center point 61, an outer perimeter 62, and defining primary apertures 75 located approximately equidistant from the center point 61 and the outer perimeter 62. The primary apertures 75 are shown as twelve, substantially round shapes, although other numbers and shapes, such as rectangles, diamonds, squares, and triangles, are within the scope of the present invention. The primary apertures 75 in this embodiment produce the mid-radial spray pattern 54 generally illustrated in FIG. 2*b* for a cylindrical canister, with a corresponding chemical concentration average gradient and percent relative standard deviation as depicted in FIGS. 3 and 4 for this spray pattern.

FIG. 6*b* illustrates a substantially square dispersal face 76 having a center point 61, an outer perimeter 62, and defining primary apertures 75 located approximately equidistant from the center point 61 and the outer perimeter 62. In addition, the dispersal face 76 includes secondary apertures 78 between the primary apertures 75 and the outer perimeter 62 and a tertiary aperture 66 proximate to the center point 61. The secondary apertures 78 are shown as six, substantially round shapes, although other numbers and shapes, such as rectangles, diamonds, squares, and triangles, are within the scope of this particular embodiment. Similarly, the tertiary aperture 66 is shown as a single, round shape, although other numbers and shapes are within the scope of this particular embodiment.

FIG. 6*c* illustrates a substantially square dispersal face 79 having a center point 61, an outer perimeter 62, an outer-zone 80 located from the outer perimeter 62 inward to approximately one-third of the distance to the center point 61, an inner-zone 81 located from the center point 61 to approximately one-third of the distance to the outer perimeter 62, and a mid-zone 82 located between the outer-zone 80 and the inner-zone 81. The dispersal face 79 defines primary apertures 83 in the mid-zone 82, secondary apertures 84 in the outer-zone 80, and tertiary apertures 85 in the inner-zone 81. The primary apertures 83 are shown as eighteen substantially round shapes arranged in multiple, concentric rows, although other numbers, shapes, and arrangements are within the scope of this particular embodiment. Similarly, other numbers, shapes, and arrangements of secondary 84 and tertiary 85 apertures are within the scope of this particular embodiment.

Figure 7A:
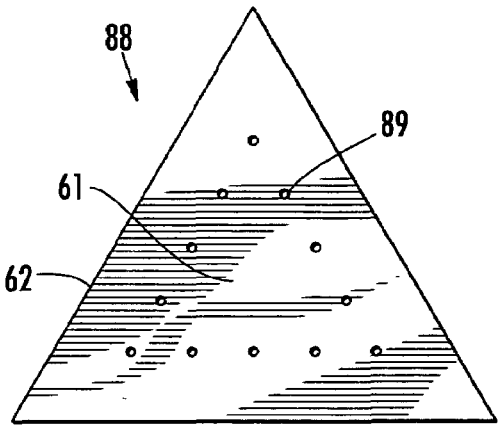
FIGS. 7*a–c* are bottom plan views of particular embodiments of a triangular dispersal face according the present invention.
Figure 7B:
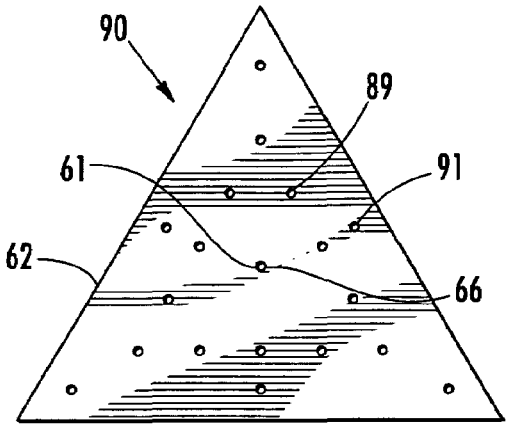
Figure 7C:
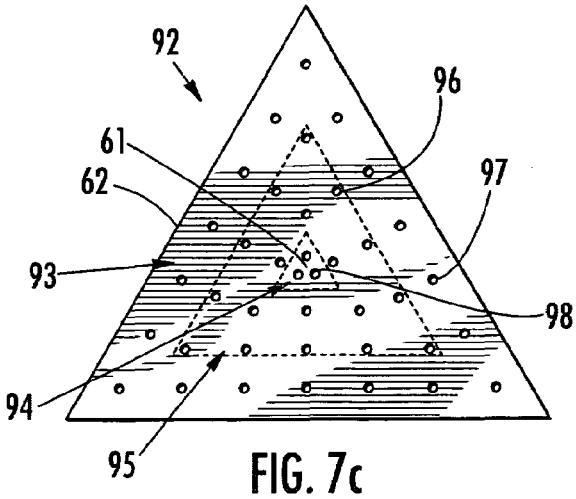

FIGS. 7*a–c* illustrate bottom plan views of particular embodiments of substantially triangular dispersal faces according to the present invention. The particular embodiments illustrated in FIGS. 7*a–c* generally correspond to the embodiments previously described, enabled, and illustrated in FIGS. 5*a–c* and 6*a–c*, with like numerals representing substantially identical structural elements.

FIG. 7*a* illustrates a substantially triangular dispersal face 88 having a center point 61, an outer perimeter 62, and defining primary apertures 89 located approximately equidistant from the center point 61 and the outer perimeter 62. The primary apertures 89 are shown as twelve, substantially round shapes, although other numbers and shapes, such as rectangles, diamonds, squares, and triangles, are within the scope of the present invention. The primary apertures 89 in this embodiment produce the mid-radial spray pattern 54 illustrated in FIG. 2*b* for a cylindrical canister, with a corresponding chemical concentration average gradient and percent relative standard deviation as depicted in FIGS. 3 and 4 for this spray pattern.

FIG. 7*b* illustrates a substantially triangular dispersal face 90 having a center point 61, an outer perimeter 62, and defining primary apertures 89 located approximately equidistant from the center point 61 and the outer perimeter 62. In addition, the dispersal face 90 includes secondary apertures 91 between the primary apertures 89 and the outer perimeter 62 and a tertiary aperture 66 proximate to the center point 61. The secondary apertures 91 are shown as six, substantially round shapes, although other numbers and shapes, such as rectangles, diamonds, squares, and triangles, are within the scope of this particular embodiment. Similarly, the tertiary aperture 66 is shown as a single, round shape, although other numbers and shapes are within the scope of this particular embodiment.

FIG. 7*c* illustrates a substantially triangular dispersal face 92 having a center point 61, an outer perimeter 62, an outer-zone 93 located from the outer perimeter 62 inward to approximately one-third of the distance to the center point 61, an inner-zone 94 located from the center point 61 to approximately one-third of the distance to the outer perimeter 62, and a mid-zone 95 located between the outer-zone 93 and the inner-zone 94. The dispersal face 92 defines primary apertures 96 in the mid-zone 95, secondary apertures 97 in the outer-zone 93, and tertiary apertures 98 in the inner-zone 94. The primary apertures 96 are shown as eighteen substantially round shapes arranged in multiple, concentric rows, although other numbers, shapes, and arrangements are within the scope of this particular embodiment. Similarly, other numbers, shapes, and arrangements of secondary 97 and tertiary 98 apertures are within the scope of this particular embodiment.

It should be appreciated by those skilled in the art that modifications and variations can be made to the embodiments of the invention set forth herein without departing from the scope and spirit of the invention as set forth in the appended claims and their equivalents.

What is claimed is:

1. An apparatus for adding liquid to a container containing a rolled or stacked absorbent material, said apparatus comprising:

a. a source of the liquid, b. a nozzle in fluid communication with said source of the liquid for dispensing the liquid into the container wherein said nozzle includes a dispersal face having an outer perimeter and a center point;

c. wherein said dispersal face defines primary apertures located approximately equidistant from said outer perimeter and said center point and secondary apertures located between said primary apertures and said outer perimeter; and d. wherein the number and size of said primary and secondary apertures differ such that the flow rate of the liquid through said secondary apertures is less than or equal to the flow rate of the liquid through said primary apertures.

2. The apparatus of claim 1, wherein each of said primary apertures has a predetermined maximum size such that when flow of liquid through said dispersal face is interrupted, the surface tension of the liquid seals said primary apertures and prevents dripping.

3. The apparatus of claim 1, wherein said outer perimeter of said dispersal face on said nozzle comprises at least one of substantially circular, rectangular, and triangular shapes.

4. The apparatus of claim 1, wherein the number and size of said primary and secondary apertures are such that the flow rate of the liquid through said secondary apertures is approximately one-half of the flow rate of the liquid through said primary apertures.

5. The apparatus of claim 1, wherein said dispersal face further defines a tertiary aperture between said primary apertures and said center point for dispensing the liquid to the container containing the absorbent material.

6. The apparatus of claim 4, wherein the number and size of said primary apertures are such that the flow rate of the liquid through said tertiary aperture is less than the flow rate of the liquid through said primary apertures.

7. The apparatus of claim 4, wherein the number and size of said primary apertures are such that the flow rate of the liquid through said tertiary aperture is approximately one-tenth of the flow rate of the liquid through said primary apertures.

8. An improved fill system for adding liquid to a container, the improved fill system comprising:

a. a source of the liquid;

b. a nozzle in fluid communication with said source of the liquid;

c. a dispersal face on said nozzle and directed to the container, said dispersal face having a center point, an outer perimeter, an inner-zone located from said center point outward to approximately one-third of the distance to said outer perimeter, an outer-zone located from said outer perimeter inward to approximately one-third of the distance to said center point, and a mid-zone located between said outer-zone and said inner-zone;

d. wherein said dispersal face defines primary apertures in said mid-zone and secondary apertures in said outer-zone; and e. wherein the number and size of said primary and secondary apertures differ such that the flow rate of the liquid through said secondary apertures from said outer-zone is less than or equal to the flow rate of the liquid through said primary apertures from said mid-zone.

9. The improved fill system of claim 8, wherein each of said primary apertures has a predetermined maximum size such that when flow of liquid through said dispersal face is interrupted, the surface tension of the liquid seals said primary apertures and prevents dripping.

10. The improved fill system of claim 8, wherein said outer perimeter of said dispersal face on said nozzle comprises at least one of substantially circular, rectangular, and triangular shapes.

11. The improved fill system of claim 8, wherein the number and size of said primary and secondary apertures are such that the flow rate of the liquid through said secondary apertures from said outer-zone is approximately one-half of the flow rate of the liquid through said primary apertures from said mid-zone.

12. The improved fill system of claim 8, wherein said dispersal face defines a tertiary aperture in said inner-zone for dispersing the liquid to the container from said inner-zone.

13. The improved fill system of claim 12, wherein the number and size of said primary apertures are such that the flow rate of the liquid through said tertiary aperture from said inner-zone is less than the flow rate of the liquid through said primary apertures from said mid-zone.

14. The improved fill system of claim 12, wherein the number and size of said primary apertures are such that the flow rate of the liquid through said tertiary aperture from said inner-zone is approximately one-tenth of the flow rate of the liquid through said primary apertures from said mid-zone.

15. A method for dispersing liquid to a container containing an adsorbent material, said method comprising:

a. obtaining a source of the liquid;

b. connecting a nozzle to said source of the liquid, wherein said nozzle includes a dispersal face that has an outer perimeter, a center point, defines primary apertures approximately equidistant from said outer perimeter and said center point, and defines secondary apertures between said primary apertures and said outer perimeter, wherein the number and size of said primary and secondary apertures differ such that the flow rate of the liquid through said secondary apertures is less than or equal to the flow rate of the liquid through said primary apertures; and c. dispensing at least as much liquid through said primary apertures to the container containing the adsorbent material as through said secondary apertures.

16. The method of claim 15, further including dispensing approximately twice as much liquid to the container through said primary apertures than through said secondary apertures.

17. The method of claim 15, further including a. connecting said nozzle to said source of the liquid, wherein said dispersal face further defines a tertiary aperture in said dispersal face between said primary apertures and said center point; and b. dispensing the liquid through said tertiary aperture to the container.

18. The method of claim 17, further including dispensing more of the liquid to the container through said primary apertures than through said tertiary aperture.

19. The method of claim 17, further including dispensing approximately ten times as much liquid to the container through said primary apertures than through said tertiary aperture.

* * * * *